United States Patent [19]

Prater

[11] Patent Number: 4,958,449

[45] Date of Patent: Sep. 25, 1990

[54] APPARATUS FOR COVERING DRILLING MUD LIQUIDS IN A SURFACE DEPRESSION

[76] Inventor: Paul L. Prater, Rte. 2, Box 50, Marlow, Okla. 73055

[21] Appl. No.: 286,242

[22] Filed: Dec. 19, 1988

[51] Int. Cl.[5] ..... E02F 3/24; E02F 3/18

[52] U.S. Cl. ..... 37/93; 37/256; 172/67; 172/109

[58] Field of Search ..... 172/63, 66, 67, 108, 172/109, 113; 405/179; 37/92, 93, 256, 253

[56] References Cited

U.S. PATENT DOCUMENTS

| | | | |
|---|---|---|---|
| 1,387,576 | 8/1921 | Worth . | |
| 1,466,187 | 8/1923 | Puth . | |
| 1,519,024 | 12/1924 | Erdman | 172/108 |
| 1,552,714 | 9/1925 | Linzy . | |
| 1,594,095 | 7/1926 | Fey et al. . | |
| 2,672,718 | 3/1954 | Thomas | 172/67 |
| 2,733,524 | 2/1956 | Ingbritson | 37/43 |
| 2,777,218 | 1/1957 | Kiecker | 37/256 |
| 3,043,027 | 7/1962 | Ruffing | 37/43 |
| 3,261,117 | 7/1966 | Shoemaker | 37/92 |
| 3,411,225 | 11/1968 | Barras | 172/108 X |
| 3,417,495 | 12/1968 | Barras | 172/108 X |
| 3,624,826 | 11/1971 | Rogers | 172/108 X |
| 3,804,178 | 4/1974 | West | 172/67 |
| 3,916,543 | 11/1975 | Poche | 172/108 |

*Primary Examiner*—Richard J. Johnson

*Attorney, Agent, or Firm*—Laney, Dougherty, Hessin & Beavers

[57] ABSTRACT

A method and apparatus for covering drilling mud returns in a drilling mud pit. A soil-projecting apparatus which is attachable to the rear of a conventional farm tractor comprises a plurality of scoop-like members connected to a drive shaft member which is operably associated with the power take-off of the tractor, independently adjustable blade membes placed forward of the scoop-like members for displacing soil toward the scoop-like members, and a protective partial enclosure of the scoop-like members. A method for covering drilling mud returns comprises placing a first, supporting layer of a material adjacent the returns and placing a layer of topsoil adjacent the first, supporting layer.

3 Claims, 4 Drawing Sheets

APPARATUS FOR COVERING DRILLING MUD LIQUIDS IN A SURFACE DEPRESSION

BACKGROUND OF THE INVENTION

1. Field of the Invention.

This invention relates generally to methods and apparatus for covering liquids in a surface depression, and more particularly, but not by way of limitation, to methods and apparatus for covering drilling mud returns in a drilling mud pit.

2. Description of the Prior Art.

Drilling mud returns from a well have generally been stored in surface depressions of one type or another, with most of such depressions having been manmade. An older method of disposing of such drilling mud returns involves digging long, deep trenches with a backhoe or similar device, pumping the returns into the trenches, and pushing soil on top of the drilling mud returns within the trenches with a bulldozer or by some other means. The primary difficulty encountered with this method is that drilling mud tends to flow out from underneath the weight of soil placed on top of the mud by flowing toward the ends of the trench. To effectively cover all of the drilling mud, then, the trench must frequently be lengthened to an excessive extent, thereby wasting time, manhours and equipment.

A newer method of disposing of the drilling mud returns involves placing the returns from various wells into a centralized disposal pit. Such pits are not infrequently a quarter of a mile in length, while being several hundred feet wide and from nine to thirty feet in depth. Disposal of the returns, as before, is generally accomplished by using a bulldozer to push soil into the pit on top of the returns. The weight of soil so placed, however, is generally too great and too localized, such that the same problem of the returns flowing out from underneath the soil is encountered.

Other soil displacing devices are known, however, which attempt to distribute the soil more evenly as it is displaced, such as that disclosed in U.S. Pat. No. 3,804,178 to West. A frame having an upright, horizontally elongated blade attached thereto is located at the forward end of a tractor. A horizontally disposed and rotatable vaned disk composed of a horizontally disposed plate and a plurality of vertically positioned vanes is located at the trailing end of the blade for throwing soil directed by the blade toward the disk. The disk is rotated by an auxiliary engine to throw the soil directed by the blade toward the disk.

The apparatus is disclosed as being tiltable laterally on an axis parallel to the path of travel of the tractor and is vertically movable, but as shown by its placement forward of the vehicle and the provision of the auxiliary engine, is not disclosed as advantageously attachable to the power take-off of a conventional farm tractor.

Further, the size of the blade provided makes adjustments for varying soil conditions impracticable over a small area. Such adjustments may be desirable, for instance, where soils of vastly different densities are presented within such a small area. The distribution of such soils over the surface of drilling mud returns can lead to the sort of uneven loading encountered with earlier methods, and thus to holes and gaps in the layer of soil covering the liquid where the liquid has flowed out from underneath the layer.

SUMMARY OF THE INVENTION

The present invention overcomes the above-noted and other shortcomings of the prior art by providing a novel and improved apparatus and method for covering drilling mud returns and other liquids displaying a like tendency to flow out from underneath a conventional landfill operation in a surface depression which effectively and conveniently prevent the flow of such liquids from underneath the soil placed thereon during the landfill operation.

A soil-projecting apparatus which is attachable to the rear of a self-propelled vehicle for forward travel is disclosed, and comprises means operably associated with the self-propelled vehicle for projecting soil laterally of the vehicle and means for displacing soil toward such projecting means. Means for directing a projection of the soil by the projecting means is also provided.

The process of the present invention for covering a liquid, and in particular drilling mud returns and other liquids displaying a like tendency to flow out from underneath a conventional landfill operation in a surface depression, comprises the steps of placing a first, supporting layer of a material adjacent the drilling mud returns or other liquid, and placing a layer of topsoil above the first, supporting layer. The process may further include the step of placing an intervening layer of subsoil between the first, supporting layer and the layer of topsoil. The apparatus of the present invention is particularly suited for the even distribution of such subsoil and topsoil in accomplishing the process, as will become apparent from the detailed description that follows.

It is an object of the present invention to provide an apparatus and method for covering drilling mud returns and other liquids having a like tendency to flow out from underneath a conventional landfill operation in a surface depression which prevent such flow.

It is also an object of the invention to provide such an apparatus which is adjustable for various terrains and soil compositions, and for liquids displaying varying degrees of the tendency described above.

It is a further object of the present invention to provide an apparatus that is easily manufactured, employed, and maintained.

It is a still further object of the present invention to provide a method and an apparatus for carrying out one or more steps of such method which can utilize the power take-off of a conventional farm tractor, such as are commonplace in certain oil-producing areas.

Other objects and advantages will become more fully apparent with a consideration of the following description, the appended claims, and the accompanying drawings.

BRIEF DESCRIPTION OF THE DRAWINGS

FIG. 8 is a rear view of the preferred embodiment adjacent a cross-sectional view of a surface depression containing a liquid which has been nearly covered by the process of the present invention.

FIG. 9 is an enlarged cross-sectional view of the surface depression of FIG. 8.

DETAILED DESCRIPTION OF THE PREFERRED EMBODIMENT

Figure 1:
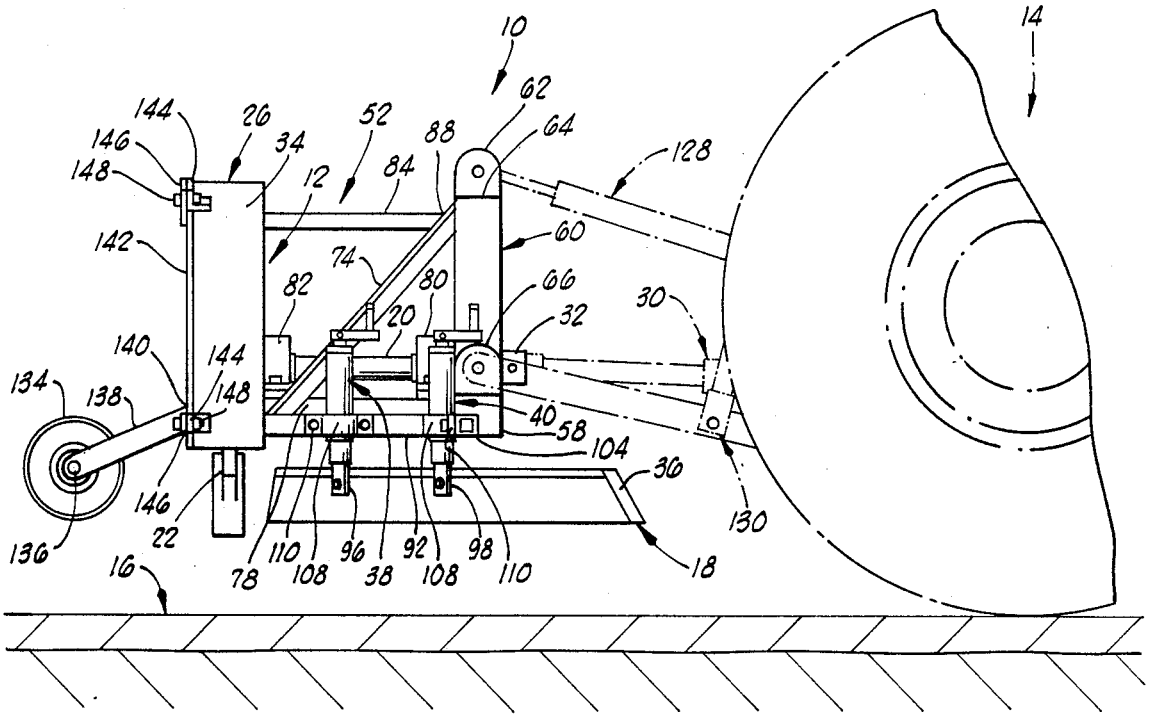
FIG. 1 is a side view of the preferred embodiment of the apparatus of the present invention in a raised position, in combination with a conventional farm tractor.

Referring now to the drawings, and particularly to FIGS. 1–5, the preferred embodiment of the apparatus of the present invention is shown and generally designated by the numeral 10. The apparatus 10 comprises means 12 operably associated with a self-propelled vehicle such as a tractor 14 for projecting soil 16 laterally of the tractor 14, and means 18 for displacing the soil 16 toward the projecting means 12. The apparatus 10 is attachable to the rear of a self-propelled vehicle for forward travel, and thus is shown as attached to the rear of the tractor 14.

Figure 5:
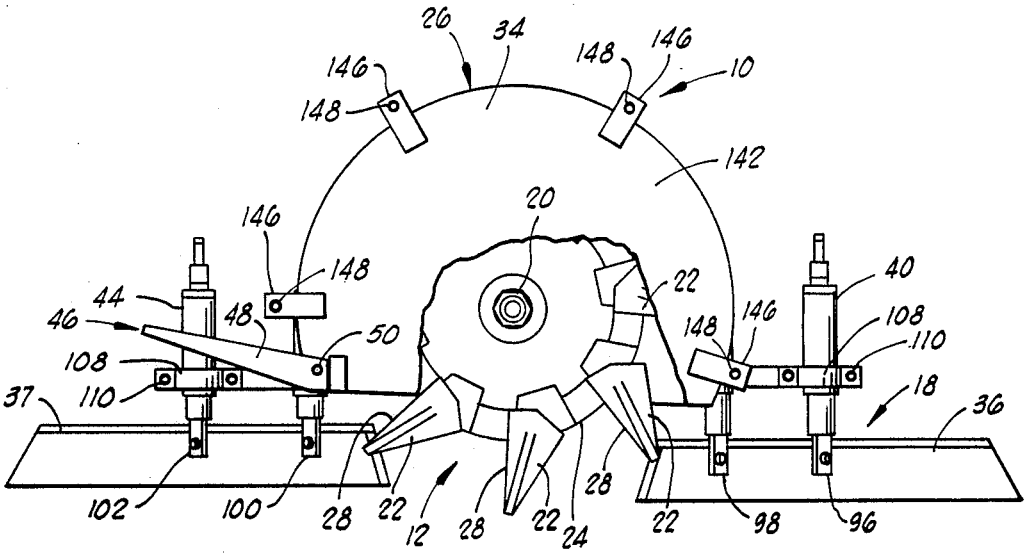
FIG. 5 is a rear sectional view of the preferred embodiment, with the independently adjustable means for directing soil toward the projecting means of the preferred embodiment shown in one operational configuration.

The projecting means 12 of the preferred embodiment comprises a drive shaft member 20 extending longitudinally of the tractor 14, appendages 22 from a substantially circular wheel portion 24 which is connected to the drive shaft member 20, and means 26 for encasing a portion of the appendages 22. In the preferred embodiment, and as best shown in FIG. 5, the appendages 22 comprise a plurality of scoops or scoop-like members 28 which are angularly spaced around the periphery of wheel portion 24 and in turn around the drive shaft member 20 to which wheel portion 24 is perpendicularly connected. The appendages 22 may be of any number of appropriate configurations, however, for moving soil laterally with respect to the tractor 14.

The drive shaft member 20 of the preferred embodiment is coupled to the power take-off 30 of the tractor 14 by a conventional U-joint 32 for rotating the drive shaft member 20, the wheel portion 24 connected thereto, and the appendages 22 from the wheel portion 24 for thus moving the soil 16 laterally with respect to the tractor 14 when the appendages 22 are rotated into contact with the soil 16.

As noted previously, the appendages 22 are partially enclosed by means 26 for encasing the wheel portion 24 and a portion of the appendages 22 connected thereto, such as a substantially circular wheelcase 34 which extends below the level of the drive shaft member 20 but which permits the appendages 22 to dig into the soil 16 to an effective depth without interference from the wheelcase 34.

The means 18 for displacing the soil 16 toward the projecting means 12 in the preferred embodiment comprises a plurality of adjustable blade members, such as blade members 36 and 37, which are placed forward of the wheel case. Blade member 36 is independently adjustable by means of a plurality of screw cranks 38 and 40, and blade member 37 is independently adjustable by means of a plurality of screw cranks 42 and 44, so that the apparatus may be used on uneven surfaces while still maintaining a resonably constant and even flow of soil 36 toward the projecting means 12 of apparatus 10.

Figure 3:
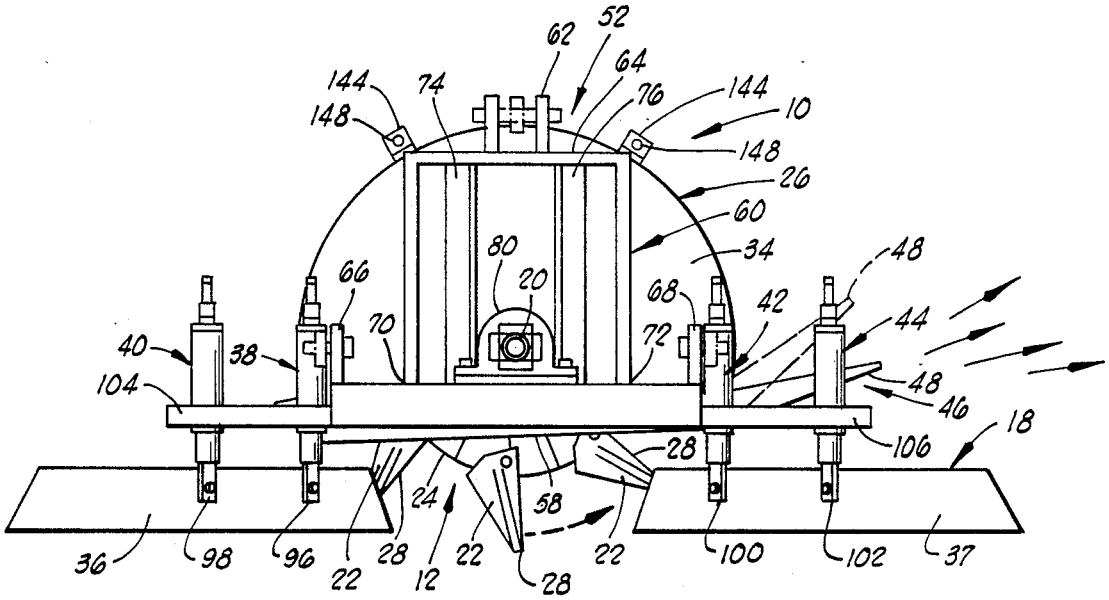
FIG. 3 is a front view of the preferred embodiment of the apparatus of the present invention.
Figure 4:
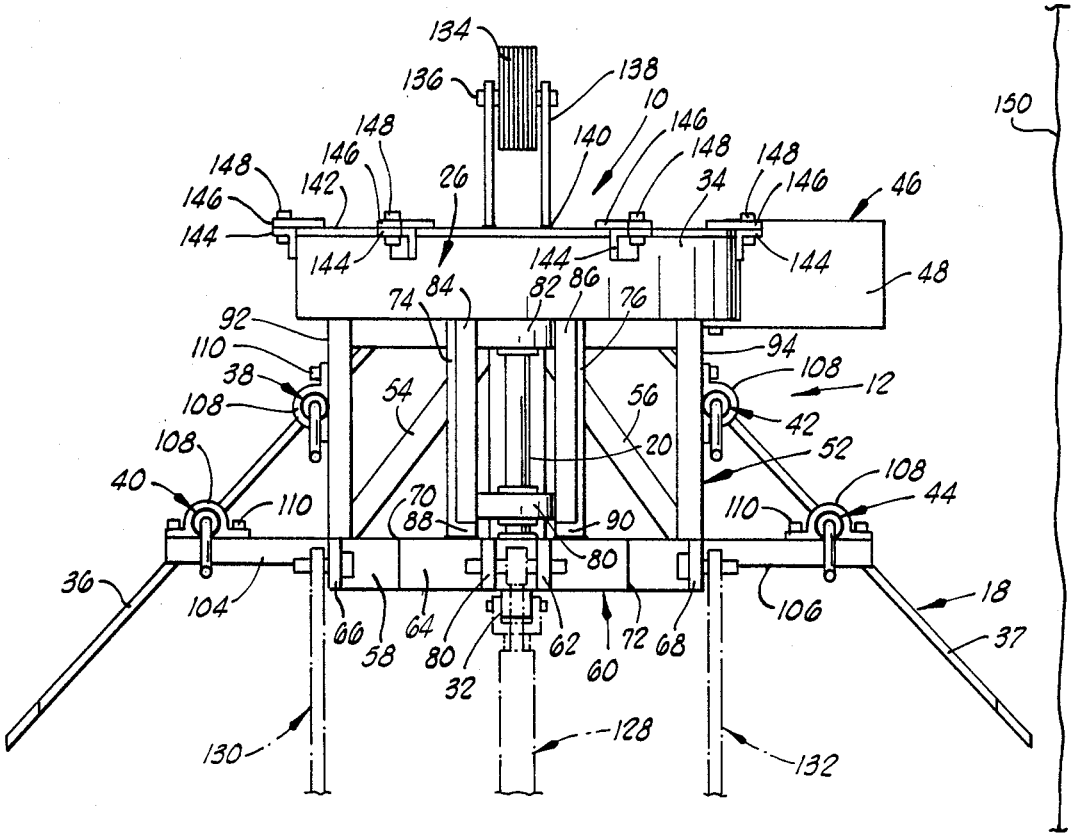
FIG. 4 is a top view of the preferred embodiment.

The preferred embodiment of the apparatus also comprises means 46 for directing a projection of the soil 16 by the projecting means 12, such as chute 48 attached to the wheelcase 34. The chute 48 is preferably adjustably directed as shown in FIG. 3, as by virtue of its pivotal attachment to the wheelcase 34 by a pin 50 which is best seen in FIG. 5. The chute 48 of the preferred embodiment may thus be vertically adjusted by virtue of the pivotal connection of the chute 48 to wheelcase 34, as from the position of the chute shown in solid lines in FIG. 3 to the position shown in phantom in FIG. 3. It is contemplated also that the chute 48 may be made simultaneously horizontally and vertically adjustable, as for example by an accordian-like construction of the chute 48. The chute 48 thus provides a measure of control over the projection of the soil 16 from the apparatus, as may be seen from the arrows provided in FIG. 3 which indicate generally the direction of movement of soil 16 through and out of the apparatus.

Wheelcase 34 is attached to a frame 52 which comprises a pair of lower angle irons 54 and 56 extending to a cross bar 58 from adjacent wheelcase 34 and from adjacent the passage of drive shaft member 20 into wheelcase 34. Extending upwardly from the cross bar 58 is a rectangular frame portion 60 having an ear 62 attached thereto at an upper side 64 thereof. Ears 66 and 68 are attached to cross bar 58 on opposite sides 70 and 72 of the rectangular frame portion 60.

Upper angle irons 74 and 76 extend downwardly from adjacent the upper side 64 of the rectangular frame portion 60 to intersect a drive shaft supporting member 78 adjacent the intersection of such member 78 and the wheelcase 34, while intersecting also lower angle irons 54 and 56. Drive shaft supporting member 78 extends from such an intersection with the wheelcase 34 to the cross bar 58, and carries bearings 80 and 82 within which the drive shaft member 20 rotates when the power take-off 30 of the tractor 14 is engaged. Additional bracing members 84 and 86 extend from the upper portions 88 and 90 of the upper angle irons 74 and 76 to the wheelcase 34 to provide additional support thereto. Further bracing members 92 and 94 are provided, and preferably extend from cross bar 58 to wheelcase 34 substantially parallel to drive shaft supporting member 78.

Blade member 36 is independently adjustably connected to the frame 52 by rods 96 and 98, and blade member 37 is independently adjustably connected to the frame 52 by rods 100 and 102. Brackets 108 and blots 110 are utilized to hold screw cranks 40 and 44 adjacent extensions 104 and 106, respectively, of the cross bar 58, with screw cranks 32 and 42 preferably held adjacent the bracing members 92 and 94.

Figure 6:
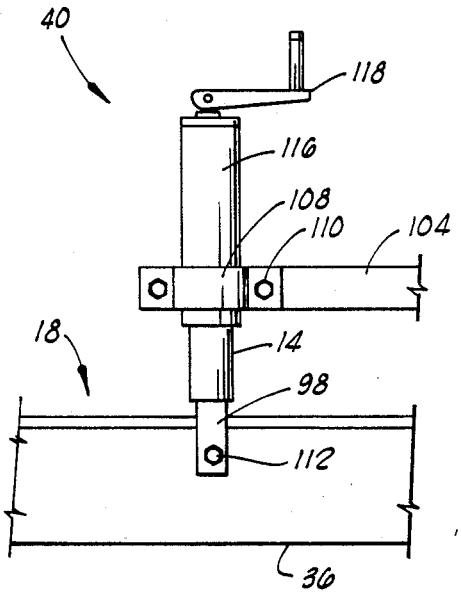
FIG. 6 is an enlarged view of the independently adjustable means for directing soil toward the projecting means of the preferred embodiment.
Figure 7:
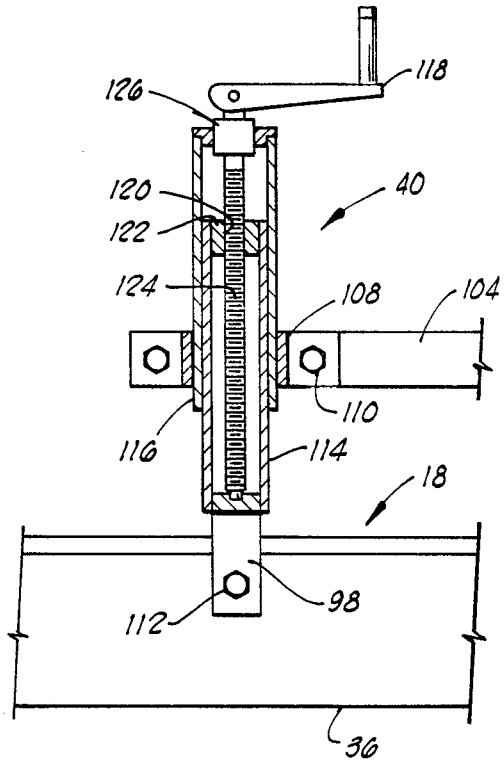
FIG. 7 is a cross-sectional view of the independently adjustable means of FIG. 6.
Figure 4:
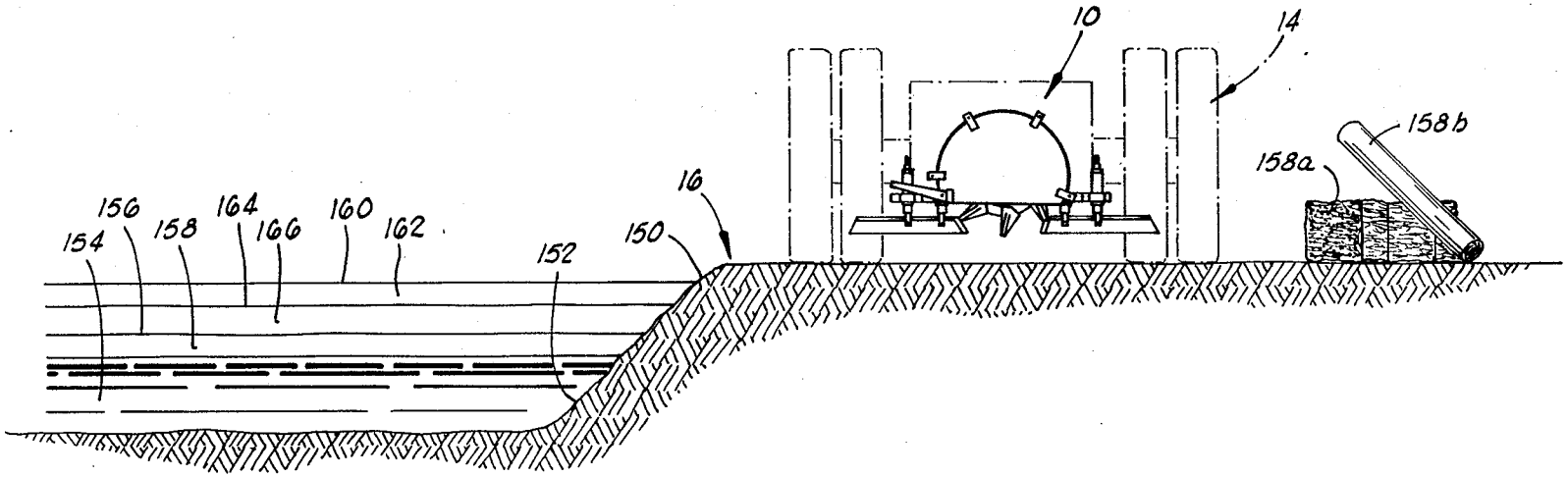
Figure 5:
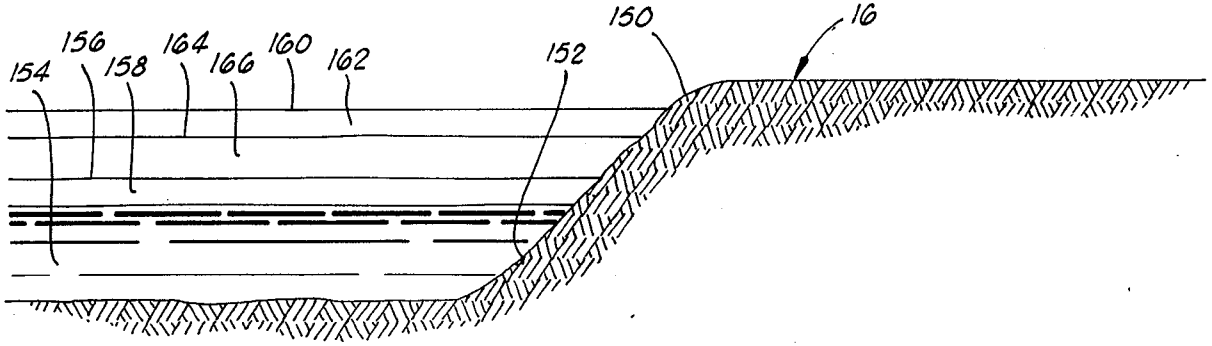

The structural and operational relationships between the blade members 36 and 37, the screw cranks 38, 40, 42 and 44, the extensions 104 and 106 and the bracing members 92 and 94, are best illustrated by reference to FIGS. 6 and 7, wherein screw crank 40 and blade member 36 are shown as representative. In the preferred embodiment as shown in FIGS. 6 and 7, the rod 98 is connected as by a bolt 112 to the blade member 36, and is preferably integrally formed with a cylinder 114 which is slidably received within the outer housing 116 of the screw crank 40. Rotation of the handle 118 to screw crank 40 operates to extend or retract the rod 98 in a conventional manner by a construction of the screw crank 40 that is well-known to persons of ordinary skill in the art.

This construction may typically be as shown in FIG. 7, wherein the cylinder 114, having a hole 120 in an upper end 122 thereof, threadingly engages a rotatable threaded member 124 rotatably and threadingly received within the hole 120. Threaded member 124 is held against vertical movement with respect to the housing 116 by a bearing 126, and rotates in response to the rotation of the handle 118. It may be seen that such rotation of the handle 118 operates, by virtue of the threaded engagement of the cylinder 114 and threaded member 124, to extend or retract the cylinder 114 with respect to the housing 116 within which the cylinder 114 is slidably received, and therefore with respect to the extension 104 to which the housing 116 of screw crank 40 is connected. Variations on the construction shown in FIG. 7 and alternative constructions of the screw crank are disclosed in U.S. Pat. No. 2,565,401 to Smith, U.S. Pat. No. 2,939,679 to Ryan, and U.S. Pat. No. 3,595,527 to Douglass. It is contemplated that the relationship between the blade members 36 and 37, screw cranks 38, 42 and 44, the bracing members 92 and 94, extension 106 and the construction relating thereto will preferably be like that just described with reference to FIGS. 6 and 7 and screw crank 40 and blade member 36.

Figure 2:
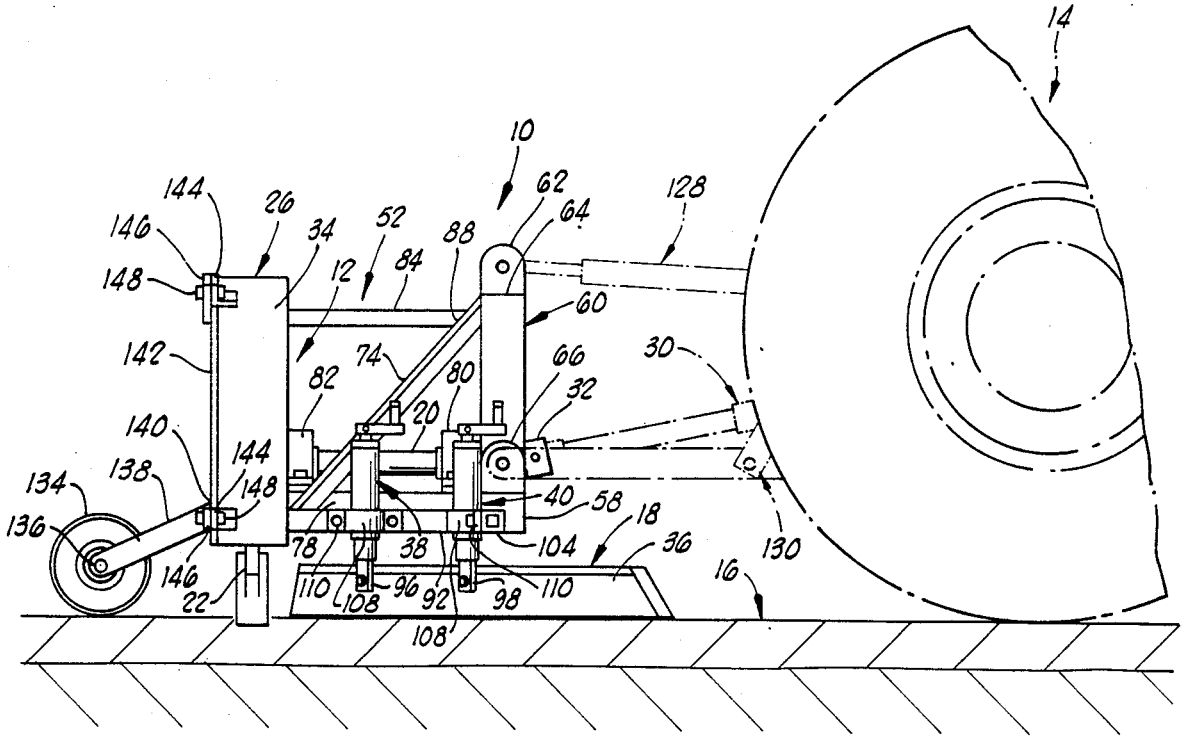
FIG. 2 is a side view of the preferred embodiment of FIG. 1 in a lowered, operational position.

Referring again to FIGS. 1–4, the apparatus as a whole is connected to the tractor 14 by virtue of a conventional threepoint connection at the ears 62, 66, and 68 by hydraulic assemblies 128, 130 and 132. These assemblies 128, 130 and 132 may be activated by the user, for example, to move the apparatus from a raised position as shown in FIG. 1 to a lowered, operational position as shown in FIG. 2.

The apparatus is further provided with a vertical adjustment wheel 134 for making the apparatus 10 vertically adjustable with respect to the soil 16. The vertical adjustment wheel 134 is provided with a removable pin attachment 136 to an outwardly extending bracket 138 which is attached in turn to a rear portion 140 of the wheelcase 34, so that wheels 134 of different sizes may be used with the bracket 138 to provide for different vertical adjustments of the apparatus under varying soil conditions.

Such adjustments may be desirable, for instance, where the soil develops a rocky character at a certain depth, in that exposure of the blade members 36 and 37 and scoop-like members 28 to such rocky soil will cause wear and deterioration of these elements of the apparatus. The vertical adjustment wheel 134 is advantageous also in countering any downward movement of the rear of the apparatus in response to the digging of the blade members 36 and 37 into the soil 16. This movement may also be countered by adjustments to the positioning of the blade members 36 and 37 through screw cranks 38, 40, 42 and 44 in the manner discussed above, so that relatively even contact with the soil 16 is maintained by the blade members 36 along their length.

It should be noted also that, to facilitate repair and/or replacement of the scoop-like members 28 of the preferred embodiment, the wheelcase 34 preferably includes a removably attached back panel 142. Back panel 142 is preferably removably attached to the wheelcase 34 by virtue of corresponding pairs of tabs 144 and 146 attached to the wheelcase 34 and back panel 142, respectively, and by virtue of nut and bolt pairs 148 placed through the tabs 144 and 146, respectively.

In operation, in moving the tractor 14 forward the power take-off 30 is engaged and rotates the drive shaft member 20, which rotates the wheel portion 24 and the plurality of scooplike members 28 attached thereto as the appendages 22 of the present invention. The apparatus 10 is lowered by means of a conventional three-point attachment at ears 62, 66 and 68 into engagement with the soil 16, whereupon the scoop-like members 28 begin projecting the soil 16 through the chute 48 toward the sur face depression which contains the liquid that is sought to be covered. The operator in general will, as shown best by FIG. 8, proceed parallel to the edge 150 of the surface depression 152, progressing outward from roughly adjacent the surface depression 152. The starting position of the tractor 14 may be reversed, of course, so that the operator progresses from an outer starting position inwardly, where soil conditions or the availability of suitable soil dictate such a manner of operation.

For instance, in the excavation of the drilling mud pit or other surface depression 152 a layer of bedrock may have been encountered. Some or all of this bedrock may eventually come to rest adjacent the surface depression. Due to the potential for wear of the blade members 36 and 37 and of the scoops or scoop-like members 28 resulting from exposure to such rocky soil, and due also to the potentially disruptive influence of such rocky soil on soil that has already been projected which is of a lesser density and perhaps incapable of supporting rocks projected thereon, the operator may consider a change in his starting position. In this situation, the operator may desire to start projecting soil from as great a distance from the surface depression 152 as the apparatus will permit.

Or it may be that, due to some other circumstance, an accumulation of soil of an appropriate character is present but at some distance from the surface depression 152. Rather than attempt to move this soil closer to the depression 152 by bulldozer or some other means, the operator may find it more convenient and economical to begin projecting this accumulation of soil from its resting place.

The independently adjustable blade members 36 and 37 are adjusted by operation of screw cranks 38, 40, 42 and 44 to appropriate heights, taking into account the contours of the land and varying soil compositions, to displace soil 16 of a consistent density and composition toward the rotating scoop-like members 28 within the wheelcase 34. The provision of independently adjustable blade members 36 and 37 permits the operator of the apparatus to compensate for different soil compositions in the areas traversed by different blade members 36 and 37. For instance, the thickness of the topsoil layer in one such area may be different from that in another such area. If the liquid sought to be covered displays a sensitivity to slight discrepancies in the weights of soil distributed thereon, the operator may take varying thickness of the topsoil layer into account by rotating screw cranks 38, 40, 42 and 44 to adjust the height of blade members 36 and 37, thus avoiding the projection of soils of perhaps widely varying density from different layers of soil. In this way, the holes and gaps of liquid that might result from such a projection are minimized, as discussed earlier.

The vertical adjustment wheel 134 provides means for maintaining the apparatus at a suitable height with respect to the soil 16, so that maximum efficiency of the apparatus may be obtained, with the apparatus neither burying itself in the soil 16 nor flinging forth only the uppermost layer of the soil 16, nor encountering soil 16 of an unduly rocky or otherwise undesirable nature.

The chute 48 is adjusted concurrent with the adjustments made to the height of blade members 36 and 37 to obtain the most efficient coverage of liquids in variously sized surface depressions, the angle of the chute 48 being varied depending at least in part on the width of the depression and on the weights and shapes of pieces of soil or other material being projected from the apparatus. For instance, in covering liquids in a very wide depression, it may be desirable to adjust the chute 48 to project material the greatest distance. Consideration of the weights of the pieces of material thrown, however, and the effects of these pieces in falling from a greater height than would be involved in shorter distance projections or in projections at a different angle with respect to the liquid surface may dictate further adjustments in the positioning of chute 48. These accommodations are generally made more difficult where the chute is not adjustably directed. The coverage resulting from the adjustments described above with respect to the chute 48 and blade members 36 and 37, whereby soil 16 is not unduly concentrated in any one portion of the surface depression or on any one area of the liquid surface to be covered, and whereby the character of the soil 16 being projected at a given time may be altered, serves to prevent or eliminate the flowing out phenomenon discussed earlier, and provides an important utility of the invention.

Referring specifically now to FIGS. 8 and 9, a method for covering a liquid 154 in a surface depression 152 comprises the steps of placing a first, supporting layer 156 of a material 158 adjacent the liquid 154 and placing a layer 160 of topsoil 162 above the layer 156 of a material 158, as shown. Hay **158*a* has been found to be suitable for the formation of a first, supporting layer 156, although it is contemplated that a polymeric sheet 158*b*, as shown in FIG. 8, could also be employed in this capacity. A preferred method for covering a liquid 154 in a surface depression 152 further comprises the step of placing an intervening layer 164 of subsoil 166 between the first, supporting layer 156 and the layer 160 of topsoil 162**.

Hay **158*a* may be placed adjacent the liquid 154 through the use of a slightly modified hammermill which, although not shown, is a commonly known and used farm implement. A conventional hammermill is modified by removing the hopper to which hay 158*a* would normally be distributed, and the hammermill is directed to throw hay 158*a* over the surface depression 152. Where a polymeric sheet 158*b* is to be employed in the capacity of the material 158 comprising the first, supporting layer 156, such a sheet 158*b* may be placed in position adjacent the liquid 154 in the surface depression 152 by persons proceeding adjacent the surface depression 152 and carrying a portion of the polymeric sheet 158*b***.

In the preferred method, as noted earlier, an intervening layer 164 of subsoil 166 is placed between the first, supporting layer 156 of hay **158*a* or the polymeric sheet 158*b* and the layer 160 of topsoil 162, as shown in greater detail in FIG. 9. A primary function of this second layer 160 is to provide a sufficiently weighty and deep covering of the liquid 154 to ensure that the liquid 154 does not easily become uncovered and to ensure a foundation for more productive uses of the land area in and immediately surrounding the surface depression 152. The apparatus of the invention is conveniently used in the manner described earlier to accomplish this second layer 160 by the projection of subsoil 162 that is either exposed to the apparatus by inversion of the soil 16 surrounding the surface depression 152 from its conventional ordering shown in FIGS. 1 and 2, as by a bulldozer, or by carrying such subsoil 162 to the site of the surface depression 152** from a remote location.

Finally, a layer 164 of topsoil 166 is placed adjacent the layer 160 of subsoil 162 by projecting the topsoil 166 from adjacent the surface depression 152 which remains after the projection of the subsoil 162, or by projecting topsoil 166 which has been carried to the site also. It can be appreciated that this projection of topsoil 166 may be accomplished, again, using the apparatus of the present invention in the manner described earlier, making the adjustments to the apparatus which have been described. A primary function of the layer 164 of topsoil 166 is to provide a medium for growing grasses or other ground cover, whereby erosion of the layers 156 and 160 below may be minimized. Accordingly, the term "topsoil" as used herein is used in its conventional sense of representing that soil which is capable of sustaining plant life in the form of grasses or the like.

While preferred embodiments of the apparatus and method of the invention have been described for the purpose of this disclosure, numerous changes in the construction and arrangement of parts of the apparatus and in the steps of the method can be made by those skilled in the art, which changes are encompassed within the spirit of this invention, as defined by the appended claims.

What is claimed is:

1. A soil-projecting apparatus which is attachable to the rear of a self-propelled vehicle for forward travel, comprising:

a frame connectable to said vehicle;

a drive shaft member supported on said frame and extending longitudinally of said vehicle, said drive shaft member being connectable to and rotatable with a power take-off of said vehicle;

a wheel portion connected to said drive shaft member;

a plurality of soil-engaging scoops angularly spaced around said wheel portion and attached thereto;

a wheel case mounted on said frame for substantially enclosing said wheel portion and at least a portion of said scoops;

a plurality of elongated blade members independently adjustably mounted to said frame and adapted for engaging soil and displacing said soil toward said scoops as said vehicle moves along a ground surface; and an adjustably directed chute attached to said wheelcase for directing soil projected from said scoops.

2. The apparatus of claim 1, further comprising means for vertically adjusting at least a portion of the apparatus with respect to said soil.

3. The apparatus of claim wherein said means for vertically adjusting a position of the apparatus comprises:

a bracket attached to said wheelcase; and a wheel rotatably attached to said bracket.

* * * * *

UNITED STATES PATENT AND TRADEMARK OFFICE

CERTIFICATE OF CORRECTION

PATENT NO. : 4,958,449

DATED : September 25, 1990

INVENTOR(S) : Paul L. Prater

It is certified that error appears in the above-identified patent and that said Letters Patent is hereby corrected as shown below:

Abstract, line 7, delete "membes" and insert --members-- therefor.

Column 3, line 67, delete "resonably" and insert --reasonably-- therefor.

Column 6, line 8, delete "sur face" and insert --surface-- therefor.

Claim 3, line 1, after "claim" and before "wherein", insert "2".

Signed and Sealed this

Fourteenth Day of January, 1992

*Attest:*

HARRY F. MANBECK, JR.

*Attesting Officer*

*Commissioner of Patents and Trademarks*